United States Patent [19]

Dolan

[11] 4,370,763

[45] Feb. 1, 1983

[54] AUTOMATIC DOSING DISPENSER

[76] Inventor: John E. Dolan, Old Orchard St., Harrison, N.Y. 10528

[21] Appl. No.: 265,555

[22] Filed: May 20, 1981

[51] Int. Cl.[3] ..... E03D 9/02

[52] U.S. Cl. ..... 4/228; 4/227

[58] Field of Search ..... 4/223, 225, 227, 228

[56] References Cited

U.S. PATENT DOCUMENTS

| | | | |
|---|---|---|---|
| 2,021,110 | 11/1935 | Strattman | 4/227 |
| 2,071,655 | 2/1937 | Purrmann | 4/225 |
| 2,600,937 | 6/1952 | Strattman | 4/227 X |
| 2,644,167 | 7/1953 | Gordon | 4/227 |
| 2,732,850 | 1/1956 | Tauksbury | 4/227 X |
| 2,736,039 | 2/1956 | Majo | 4/227 |
| 2,888,685 | 6/1959 | Giangrosso et al. | 4/227 |
| 3,290,698 | 12/1966 | Joyner et al. | 4/228 |
| 4,296,503 | 10/1981 | Leardi | 4/228 |

*Primary Examiner*—Henry K. Artis

*Attorney, Agent, or Firm*—John F. Ohlandt

[57] ABSTRACT

Dispensing apparatus for dispensing bleach or detergent into a toilet tank or the like on a controlled basis. The dispensing apparatus comprises a dispenser immersed in the tank water, the dispenser being subdivided into two approximately equal volume chambers, one for containing the bleach and the other for the combination of a dye with a detergent. The internal structure is such that a metered dose of a liquid solution formed from a block or cake of detergent or bleach is automatically dispensed each time the flushing of the toilet tank takes place. An intake means, including an aperture or opening, is provided at one end of each of the chambers for receiving a predetermined quantity of liquid from the tank; also there are provided barrier means or similar means internally of the chamber for retaining said quantity and keeping it isolated from the bleaching or detergent block until a flushed cycle is initiated; a flotation means in the form of a compartment within the chamber containing trapped air and located at the other end of the dispenser; exit means, in the form of an opening at that other end; and means for enabling movement of the dispenser as the level of said liquid rises and falls such that the force produced by the flotation means at the one end causes the intake means to take in a predetermined quantity of liquid, and dispensing takes place through the exit openings, in accordance with gravity, as the barrier means is overcome.

9 Claims, 9 Drawing Figures

AUTOMATIC DOSING DISPENSER

BACKGROUND OF THE INVENTION

1. Field of the Invention

The present invention pertains to an automatic dosing-type dispenser for such products as toilet tank additives; for instance to bleaches, detergents, and dyes or the like. More specifically, the present invention is directed to a dispenser having no internal moving parts, but instead relying on movement of the whole apparatus to produce the necessary dispensing action.

2. Background Information

There has existed a long-standing need for dispensing a bleach, detergent and dye or the like on an automatic basis into a toilet bowl so as to be sure that such will be kept in a completely sanitary state, or at least to require very infrequent cleaning by the user.

A variety of approaches have been taken to meet this need. For example, one form of dispenser may be appreciated by reference to U.S. Pat. No. 3,504,384 to Radley et al issued Apr. 7, 1970. This patent discloses a duel dispenser for separately dispensing a detergent/dye solution and a hypochlorite (bleaching) solution into the flush water during the flushing operation. An important drawback of such scheme is that during the interval between flushes, relatively concentrated solutions of the bleach and detergent/dye compositions form in the respective dispensing chambers, and these solutions are discharged into the flush water on the next flushing operation. However, since the inlet and outlet ports of the dispensing chambers in the Radley et al dual dispenser are not closed between flushings, there is an opportunity for ingredients in the respective concentrated solutions in the chambers to diffuse into the tank water between flushes. Accordingly, there is also opportunity for ingredients from one dispensing chamber ultimately to find their way into the solution in the other dispensing chamber, and this is clearly undesirable since the dye will be rendered colorless in most cases and not provide its signalling function to the user.

In order to overcome the drawback in Radley et al, various proposals have been set forth in, for example, U.S. Pat. No. 3,831,205 in which there is disclosed an automatic dispensing apparatus for dispensing a solution formed from a solid material when the liquid level of a process stream e.g. level of tank water, drops below a predetermined level. However, such apparatus includes a float valve operative to dispense a needed amount of the solution into the flush tank at the end of a flush cycle. For reasons already indicated or which will become apparent, it is undesirable to include moving internal parts in a dispensing apparatus of this type since they are somewhat unreliable and shorten the life of the apparatus.

Other dosing dispensers known in the art are those disclosed in U.S. Pat. No. 4,171,546 in which a predetermined volume of a toilet tank additive solution is dispensed into a toilet tank as the water is draining therefrom; such dispensers comprising a reservoir in which a solid product is dissolved to form a product solution. However, such apparatus or device relies on vacuum transfer into the reservoir through an inlet conduit and relies on dispensing a dose volume of the product solution through a discharge standpipe. Such dispenser also provides an air lock when immersed in a full toilet tank so as to isolate the product and product solution from the toilet tank water surrounding the dispenser during quiescent periods; this patent also discloses the notion of co-dispensing several products into the toilet tank water.

Whatever the merits of the dispenser in the aforenoted U.S. Pat. No. 4,171,546, it will be appreciated that such involves a fairly complicated structure, although it does eliminate internal moving parts. Because of the complicated structure, however, a fairly expensive fabrication operation is called for to produce the dispenser, which is usually made of plastic.

Other patents that may be referred to for background material are: U.S. Pat. Nos. 4,186,856, 4,208,747, 4,036,407.

Whatever the particular construction, methods and advantages of the various reference devices or apparatus, it turns out that they do not fulfill the particular requirements and purposes of the present invention.

Accordingly, it is a primary object of the present invention to provide an automatic dispensing apparatus that will readily dispense either detergent or bleach, or both together, with provision for isolating each from the other in the latter case, and in any event, from the tank water.

Another primary object of the invention is to keep the bleach isolated from the entire body of liquid; that is, the tank water, during the quiescent periods between flushings; likewise, to keep the detergent/dye combination isolated from the tank water.

Yet another object is to provide a vastly simplified and inexpensive structure which will operate automatically in achieving the aforenoted objects.

Another object is to avoid the use of internal moving parts and to rely simply on the movement of the dispenser as a whole under appropriate conditions of mounting or positioning.

A further object is to enable ease of fabrication of the plastic dispensing apparatus.

Applicant's solution to the previously stated drawbacks and deficiencies in the prior art revolves around the exploitation of hydraulic and gravitational forces; specifically, of forces due to flotation of the dispenser in the tank water, and reliance on movement of the dispenser under the force of gravity when the liquid level drops in the tank.

It will of course be understood that it is generally known to rely on flotation and gravity in similar contexts. For example, Australian Pat. No. 222,793 discloses a liquid disinfectant dispensing device which utilizes buoyant or flotation means for holding a container in a first position when a tank or cistern is full, and for permitting a reservoir filled with liquid under that first condition to release its contents when the water level in the tank or cistern drops during a flushing cycle. Disclosures to somewhat the same effect: that is, disclosures of the same general principle or teaching may be obtained from the following references:

U.S. Pat. Nos. 1,365,642, 1,227,997, 2,644,167;

British Pat. Nos. 946,812, 1,057,865.

Although the cited references pertaining to flotation means, or embodying flotation or buoyant principles, accomplish their own objects, they do not satisfy or fulfill the previously stated objects achieved by the present invention.

SUMMARY OF THE INVENTION

The above objects are fulfilled and implemented in accordance with certain primary features of the present invention. One primary feature relates to a simplified structure according to which at least one chamber is provided in the dispenser, the dye and detergent combination for example being contained in block form within that chamber; and in which exit and intake openings are provided at opposite ends longitudinally of the dispenser, with barrier means provided for isolating a predetermined amount of liquid taken in through the intake means from the block of dye/detergent. The desired predetermined quantity of liquid is taken in as the flushing cycle is ending, i.e., when the water level or liquid level in the tank has risen such that the dispenser is tilted due to buoyant force and liquid is able to enter through the intake openings.

Another primary feature resides in the provision of the integral flotation means forming part of the dispenser. A compartment containing trapped air serves as the flotation means in a preferred embodiment; exit means in the form of openings adjacent the air float compartment are provided for allowing the requisite dose amount of liquid solution, partly formed at high concentration during a previous flushing cycle, to be dispensed as a result of the predetermined quantity of liquid taken in at the other end being enabled to surmount the barrier means in the dispenser chamber as the level of liquid in the tank falls.

A more specific arrangement according to the present invention includes at least one chamber for producing a dose amount of liquid solution of a detergent or the like to be dispensed into said body of liquid as the level of said body falls; intake means at one end of said dispenser for receiving a predetermined quantity of liquid from said body; said chamber within said dispenser holding a block of solid material from which said liquid solution is to be formed, and including means for initially retaining said predetermined quantity of liquid and isolating it from said block of material; floatation means at the other end of said dispenser; exit means for permitting the dose amount of liquid solution to flow out of said dispenser; means for moving said dispenser in accordance with the force produced by said flotation means at said one end as the level of said body of liquid rises, such that said intake means receives said predetermined quantity of liquid while said exit means cannot receive any substantial quantity from said body; and such that said dose amount of liquid solution is dispensed in accordance with gravity through said exit means as the level of the body of liquid falls.

Other and further objects, advantages and features of the present invention will be understood by reference to the following specification in conjunction with the annexed drawing, wherein like parts have been given like numbers.

BRIEF DESCRIPTION OF THE DRAWING

FIG. 5 is a similar view of FIG. 4 but showing the stage in the operation when the dispenser is in the process of dispensing the liquid solution of detergent, bleach or the like.

DESCRIPTION OF PREFERRED EMBODIMENTS

Figure 1:
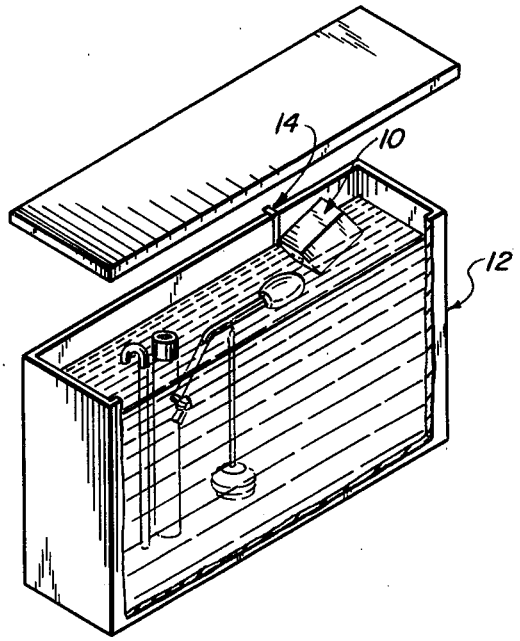
FIG. 1 is a perspective view of a toilet tank or cistern in which the dispenser of the present invention is typically utilized.
Figure 2:
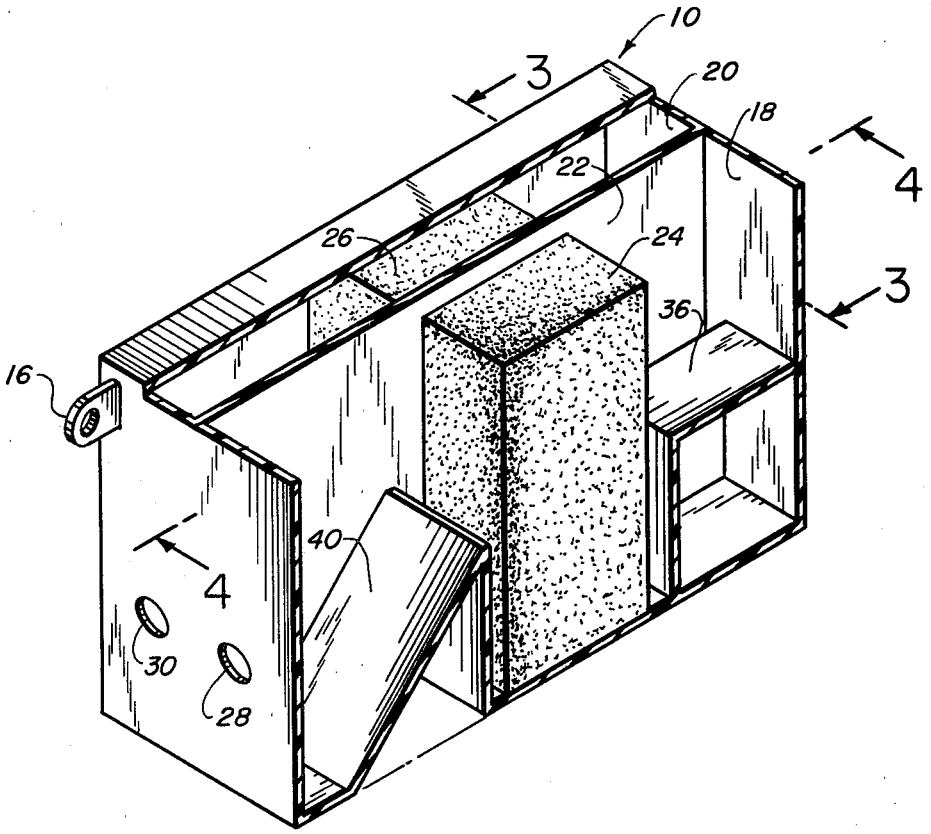
FIG. 2 is a perspective view broken away of the dispenser of the present invention.
Figure 3:
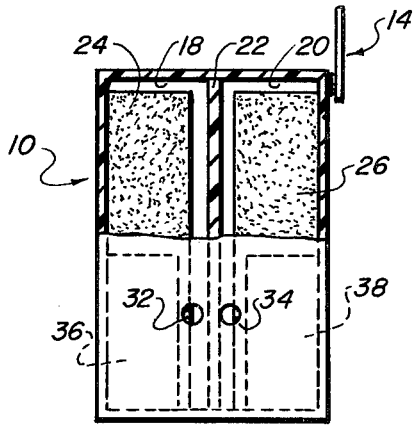
FIG. 3 is an end view of the dispenser, broken away, particularly illustrating the exit end of the device and the exit openings therein.

Referring first to FIGS. 1 through 3, there will be seen a dispenser device 10 in accordance with the present invention and, particularly as seen in FIG. 1, adapted to float in a body of liquid in a toilet tank or cistern 12. The dispenser is retained or held by a holder mechanism 14 adapted to be affixed to the rim of the toilet tank. The dispenser 10 is fitted with a bracket 16 for suitable connection to a hook or the like at the end of holder 14.

The dispenser 10 as seen in FIG. 2 is subdivided into two chambers 18 and 20 by a partition or wall 22 running longitudinally. Contained within the chamber 18 is a source of bleach, preferably calcium hypochlorite, in the form of a stick or block 24. The other longitudinal chamber 20 has a stick or block 26 of a combination of a blue or green dye and a detergent.

It will be understood that, instead of what amounts to a dual dispenser as depicted in FIG. 2 suitable for dispensing bleach on the one side, and on the other side, a combination of detergent and dye, a single source of either material can be utilized in a unitary chamber of the form to be described. That is to say, a single material dispenser can be selected in accordance with the principles of the present invention. However, it is regarded as especially advantageous to be able to dispense several materials separately into the tank water during the flushing cycle for reasons already explained.

It will be especially noted from FIGS. 2 and 3 that an inlet opening 28 is provided for chamber 18, and a corresponding inlet opening 30 for adjoining chamber 20 containing the detergent and dye combination; also, that appropriate exit or outlet openings 32 and 34 are provided at the other end of the respective chambers 18 and 20.

A flotation means, in the form of a compartment 36, is included at the lower part of the exit end of dispenser 10. Likewise a compartment 28 is provided in chamber 20. It will be appreciated that these compartments 36 and 38 are filled with air and hence act as "air floats." A barrier or isolation means in the form of an inclined wall 40 and a connecting wall 42 are provided, whereby, when as seen in FIG. 4, the dispenser 10 is in the normal condition, defined as a maximum level for the tank water, a reservoir of predetermined quantity 44 is contained by the inclined wall 40 and the surrounding bottom and side walls.

It will, of course, be understood that a similar situation obtains in the other chamber 20 which contains the detergent-dye combination. Thus, a completely corresponding reservoir of predetermined liquid taken in through the opening 30 is created on that side; and is restrained by a corresponding barrier means.

Figure 4:
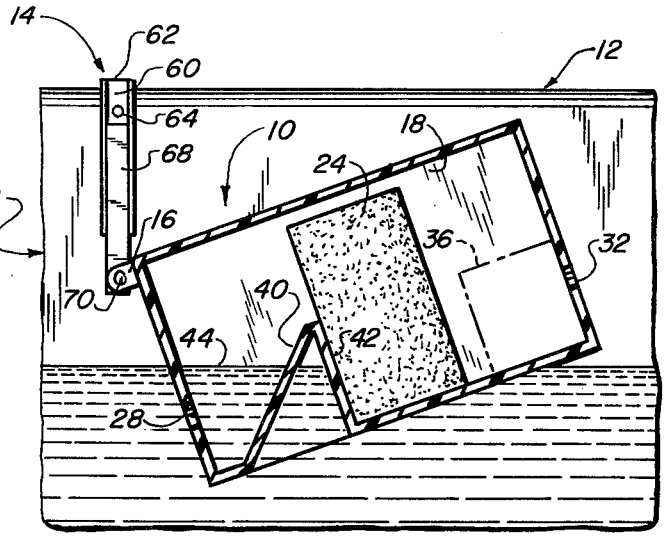
FIG. 4 is a sectional view, taken on the line 4—4 of FIG. 2, illustrating the operation of the dispenser, and in particular showing the position of the dispenser when the tank has been filled.

Accordingly, it will be apparent from FIG. 4 that there is complete isolation between the reservoir 44 and the block or cake of bleach 24 during the quiescent period depicted; that is, during the period between flushings. Thus, although the reservoir 44 is always in fluid communication with the body of liquid in the tank, there is not a substantial continuous erosion of the bleach. Instead, the cake of bleach 24 will only be dissolved either during the active periods as liquid flows over the barrier, or in the quiescent periods to the extent that a slight amount of liquid comes in contact with the block 24 due to a previous flushing, as will be explained, whereby a highly concentrated solution is permitted to develop.

Figure 5:
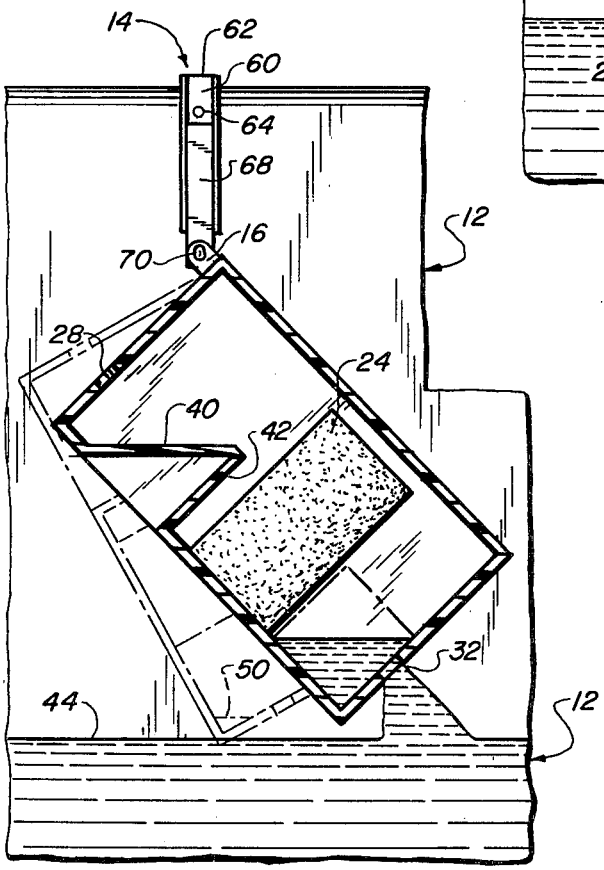

Referring now to FIG. 5, it will be noted that in the operation of the dispenser, i.e., when the toilet tank is flushed and the liquid drops to the level seen, the dispenser 10 is free to move; that is to rotate about the pivot point established by the bracket 16 in engagement with the holder 14. As a result the water contained in reservoir 44 is lifted over the barrier 40 and moves through the chamber 18 carrying any previous residue of liquid solution with it and exits from the outlet or exit opening 32. The solid line showing in FIG. 5 illustrates a position just prior to the ultimate position shown in phantom outline. At the latter position, as indicated, there remains a residue of liquid 50 in the chamber 18.

It will be understood that, as indicated previously, the same activity as just described is also taking place in the other chamber 20 so as to release a liquid solution formed from the detergent/dye combination 26.

When the dispenser 10, after emptying the contents of its respective chambers, except for the noted residue, returns to the normal position depicted in FIG. 4, that residue will of course surround the cake of bleach 24, and likewise the cake of detergent/dye combination 26, so as to begin to dissolve those materials. Accordingly, an amount of concentrated liquid solution becomes available to be further mixed and to be swept out at the next flushing cycle. It should be noted also that when the water in the tank first starts to rise, it is possible, depending upon the materials used and the location of the exit holes 32 and 34, that the exit holes might be momentarily under the water level at that time. It will be appreciated, however, that this is not undesirable in that a small amount of water is useful in forming, during the quiescent period, concentrated liquid solution with the bleach and with the detergent/dye combination.

In the manufacture of the dispenser 10, it is preferred that it be injection molded from polyethylene or polypropylene or other relatively rigid materials which are substantially inert with respect to the intended product and aqueous solutions of that product. Alternatively, the plastic dispenser 10 could be vacuum thermoformed, another technique well known in the art.

Figure 6A:
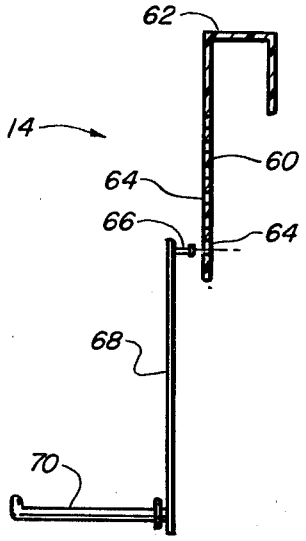
FIG. 6A is a side elevation view of one form of adjustable holder used with the dispenser.
Figure 6B:
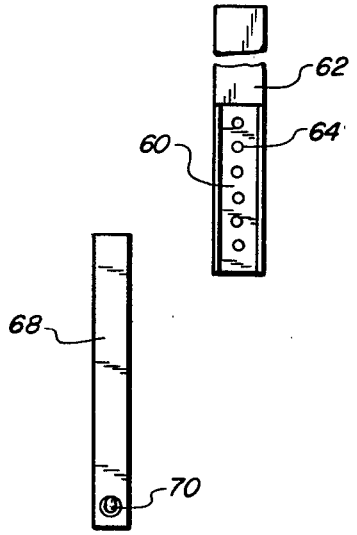
FIG. 6B is a front elevation view of the dispenser illustrated in FIG. 6A.
Figure 7A:
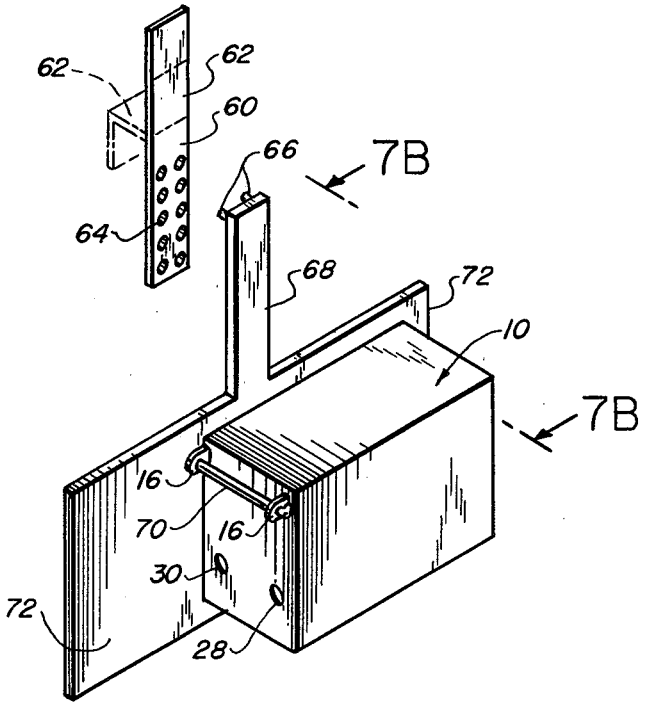
FIG. 7A is a front elevation view of another form or type of holder for holding the dispenser apparatus.
Figure 7B:
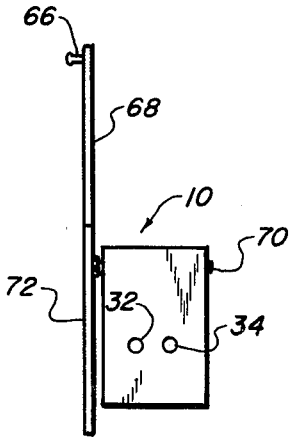
FIG. 7B is an elevation view, from the exit end, of the holder of FIG. 7A.

Referring now to FIGS. 6 and 7, there will be seen in FIG. 6A a side view of a first form or embodiment for the adjustable holder 14, which is preferably made of polyethylene or polypropylene. The holder is also made to be adjustable so that it can accommodate whatever toilet tank water level is encountered by the user, it being important, as will be understood, that the dispenser be placed in the tank at the right level in order to function properly.

The particular holder in FIG. 6A comprises an arm 60 formed to have a clip 62 at its upper end so as to engage the tank rim. The arm 60 is provided with a plurality of openings 64 for engaging tab 66 formed on the movable member 68, that member carrying a hook 70 to be engaged by the bracket 16 of the dispenser 10. The member 68 is adjusted according to the instructions given the user so that the appropriate position for the dispenser will be attained with respect to the liquid level in the tank. Thus, the member 68 has its tab 66 fitted into a hole 64 at the proper level to accomplish this purpose.

The second form of holder depicted in FIG. 7A is similar to that seen in FIG. 6A except that the member 68 is formed to have a plate-like portion 72 at its lower end and to have its projecting hook 70 for engaging bracket 16 slightly shifted from a central axis. This form of the holder is conceived in order to assure that the dispenser 10 will not be located by the user too close to the tank side wall and thus be impeded in its automatic operation. This second form or type of holder is provided with pairs of spaced openings 64 and a corresponding pair of tabs 66.

In the event that it is found to be desirable to prevent movement of the blocks 24 and 26 during shipment, restraining members (not shown) with suitably dimensioned vertical walls and a top wall may be fitted over the blocks.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed:

1. A dispenser immersible in a body of liquid, said dispenser comprising:
   - at least one chamber for producing a dose amount of liquid solution of a detergent or the like to be dispensed into said body of liquid as the level of said body falls;
   - intake means at one end of said dispener for receiving a predetermined quantity of liquid from said body;
   - said chamber within said dispenser holding a block of solid material from which said liquid solution is to be formed, and including means for initially retaining said predetermined quantity of liquid and isolating it from said block of material;
   - flotation means at the other end of said dispenser;
   - exit means for permitting the dose amount of liquid solution to flow out of said dispenser;
   - means for moving said dispenser in accordance with the force produced by said flotation means at said one end as the level of said body of liquid rises, such that, said intake means receives said predetermined quantity of liquid while said exit means cannot receive any substantial quantity from said body; and such that said dose amount of liquid solution is dispensed in accordance with gravity through said exit means as the level of the body of liquid falls.

2. A dispenser as defined in claim 1, in which said means for moving includes a holder for said dispenser, and a bracket on said dispenser for engaging said holder.

3. A dispenser as defined in claim 1, in which said flotation means comprises a compartment containing trapped air.

4. A dispenser as defined in claim 1, in which said intake means for receiving comprises an intake opening at said one end.

5. A dispenser as defined in claim 1, in which said exit means comprises an opening at said other end.

6. A dispenser as defined in claim 1, in which said means for retaining includes a barrier means in the form of an inclined wall in said chamber 7. A dispenser as defined in claim 6, in which said barrier means is so configured as to restrict flow of the predetermined quantity of liquid within said chamber even as the level of the body of liquid reaches a maximum.

8. A dispenser as defined in claim 1, in which first and second chambers are defined by a common longitudinal wall in said dispenser.

9. A dispenser as defined in claim 8, in which said first chamber contains a block of bleach material and said second chamber contains a block of detergent and dye.

* * * * *

UNITED STATES PATENT AND TRADEMARK OFFICE

CERTIFICATE OF CORRECTION

PATENT NO. : 4,370,763

DATED : February 1, 1983

INVENTOR(S) : JOHN E. DOLAN

It is certified that error appears in the above–identified patent and that said Letters Patent are hereby corrected as shown below:

On The Title Page, in the Abstract

Line 17, "flushed" should read --flushing--.

Column 3, line 37, "floatation" should read --flotation--.

Column 4, line 53, "compartment 28" should read --compartment 38-

Column 6, line 41, "dispener" should read --dispenser--.

Signed and Sealed this

Seventh Day of June 1983

[SEAL]

*Attest:*

DONALD J. QUIGG

*Attesting Officer*

*Acting Commissioner of Patents and Trademarks*